US011766144B2

(12) United States Patent
Kraus

(10) Patent No.: US 11,766,144 B2
(45) Date of Patent: Sep. 26, 2023

(54) CONTAINER STABILITY MOUNTING APPARATUS

(71) Applicant: Christopher Levi Kraus, Big Bear Lake, CA (US)

(72) Inventor: Christopher Levi Kraus, Big Bear Lake, CA (US)

( * ) Notice: Subject to any disclaimer, the term of this patent is extended or adjusted under 35 U.S.C. 154(b) by 0 days.

(21) Appl. No.: 17/345,938

(22) Filed: Jun. 11, 2021

(65) Prior Publication Data

US 2021/0386229 A1 Dec. 16, 2021

Related U.S. Application Data

(60) Provisional application No. 63/038,440, filed on Jun. 12, 2020.

(51) Int. Cl.
*A47G 23/02* (2006.01)

(52) U.S. Cl.
CPC ..... *A47G 23/02* (2013.01)

(58) Field of Classification Search
CPC ..... A47G 23/02; A47G 23/0225
See application file for complete search history.

(56) References Cited

U.S. PATENT DOCUMENTS 4,040,549 A * 8/1977 Sadler ..... B60N 3/103 248/346.11
4,400,856 A * 8/1983 Tseng ..... B60P 7/13 403/348
4,681,239 A 7/1987 Manns et al.
4,955,493 A * 9/1990 Touzani ..... B65D 1/0292 220/666
5,626,435 A * 5/1997 Wohlhuter ..... F16B 21/02 403/348
6,094,935 A * 8/2000 Stein ..... A47G 19/2288 62/530
6,302,617 B1 * 10/2001 Rumpp ..... F16B 21/02 403/348
6,318,683 B1 * 11/2001 Savoy ..... A47G 23/0225 403/348
7,770,748 B2 * 8/2010 Elliott ..... A47G 19/2205 215/393

(Continued)

OTHER PUBLICATIONS

ZORO, Drink Holder, Black, 2005, www.zoro.com.
RAM, Self-Leveling Cup Holder with 1 Ball & Koozie, 2020, pilotmall.com.

*Primary Examiner* — Kimberly T Wood

(57) ABSTRACT

A container stability mounting apparatus allows a user attach or detach a beverage container such as thermal foil flasks to various surfaces or objects such as, but not limited to, outdoor equipment. The container stability mounting apparatus includes an anchoring base, a connector sleeve, a first attachment mechanism, and a second attachment mechanism. The anchoring base is a structural support that can be mounted to various surfaces or objects through the second attachment mechanism. The connector sleeve can receive a beverage container and can be attached to the anchoring base through the first attachment mechanism. With a beverage container situated within the connector sleeve, a user can attach or detach the beverage container to various surfaces or objects through the anchoring base.

14 Claims, 12 Drawing Sheets

(56) References Cited

U.S. PATENT DOCUMENTS

| | | | | |
|---|---|---|---|---|
| 8,191,844 | B2 * | 6/2012 | Pennino | B62J 11/04 248/220.21 |
| 8,534,060 | B1 * | 9/2013 | Bennett | B62D 11/08 60/458 |
| 9,027,892 | B2 * | 5/2015 | Boer | B64D 47/00 248/222.52 |
| 9,273,707 | B2 * | 3/2016 | Lee | A44B 13/007 |
| 9,437,969 | B2 * | 9/2016 | Witter | F16B 1/00 |
| 9,485,806 | B1 * | 11/2016 | McClendon | H05B 3/02 |
| 9,888,799 | B2 | 2/2018 | Andrieux et al. | |
| 2004/0200941 | A1 * | 10/2004 | Dennis | B60N 3/103 248/311.2 |
| 2013/0228486 | A1 | 9/2013 | Buck | |

* cited by examiner

CONTAINER STABILITY MOUNTING APPARATUS

The current application claims a priority to the U.S. Provisional Patent application Ser. No. 63/038,440 filed on Jun. 12, 2020.

FIELD OF THE INVENTION

The present invention generally relates to a set of mounting apparatuses. More specifically, the present invention is a container stability mounting apparatus that allows a user to quickly attach a beverage container, such as thermal foil flasks to a piece of outdoor equipment, then detach the beverage container when needed.

BACKGROUND OF THE INVENTION

Water is an essential substance to sustain life. Mayo clinic indicated that an adult male should drink 3.7 liters of water on a daily basis, an adult female should drink 2.7 liters on a daily basis. Furthermore, outdoor exercise will increase water consumption to avoid dehydration. However, many issues arise regarding how to access water while exercising outside. For example, there are exercise equipment that does not have a connector, such as snowboards, skies, or kayaks paddle boards, so the user has harder time to drink fluid during those exercise, and subject to higher risk of dehydration. Moreover, it is also very important to have a locking mechanism, so the user does not need to worry about catching or holding the thermal foil flask during performance of vigorous activities that require the use of equipment.

The present invention provides a solution to all issues mentioned above by creating a new type of connector. The present invention comprises two parts, where one part is attached to the outdoor equipment, and the second part is attached to the thermal foil flask. The user may retrieve the thermal foil flask by simply twist the second part to unlock the thermal foil flask from the connector, then lock the thermal foil flasks to the connector by twist the second part in a different direction. With the present invention, the user does not need to worry about the thermal foil flasks falling out from the connector and rolling all over the place.

DETAIL DESCRIPTIONS OF THE INVENTION

Figure 1:
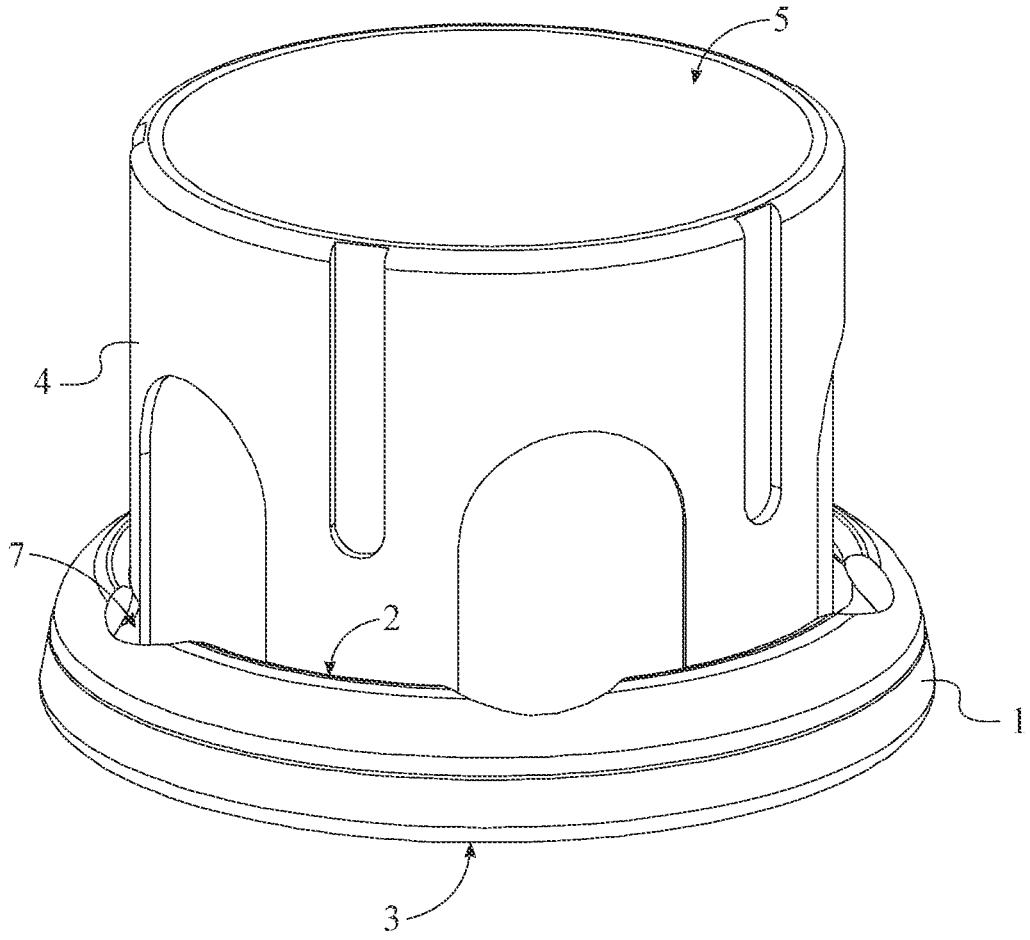
FIG. 1 is a front top perspective view of the present invention.
Figure 2:
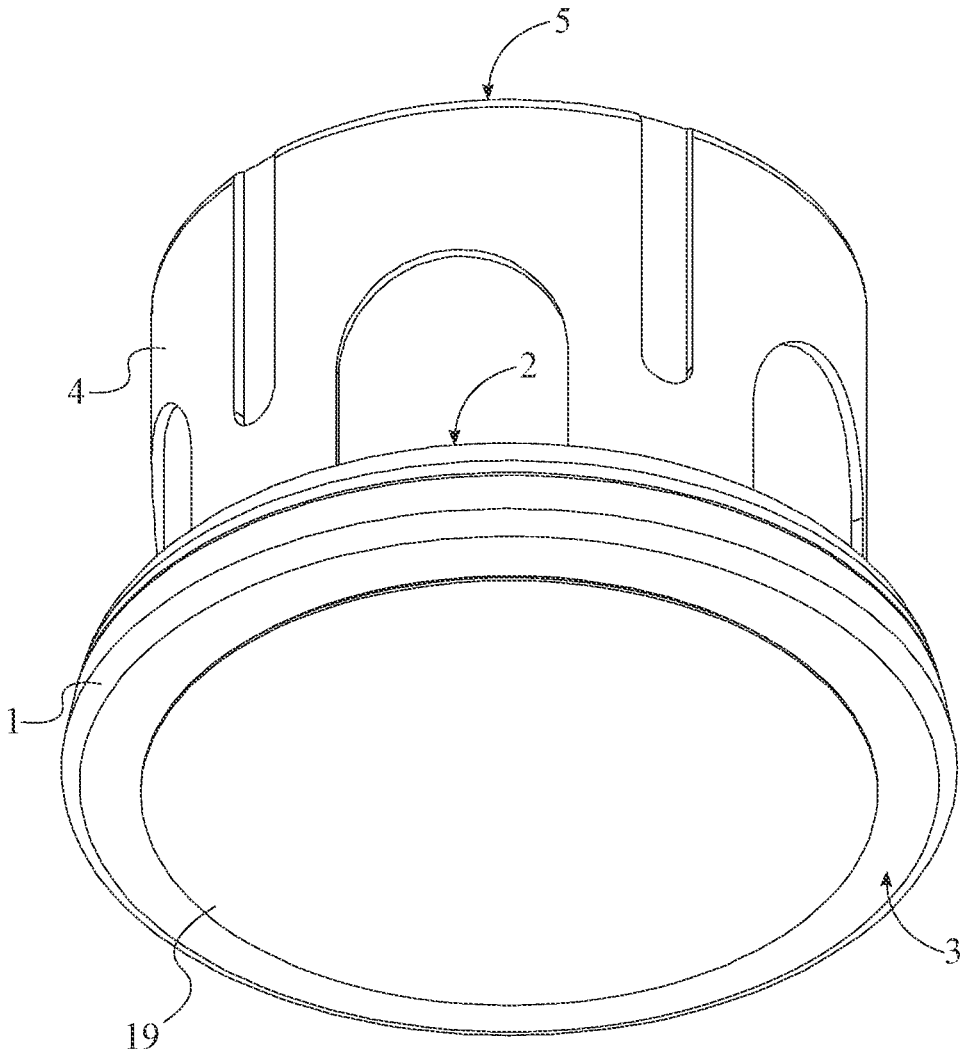
FIG. 2 is a front bottom perspective view of the present invention.

All illustrations of the drawings are for the purpose of describing selected versions of the present invention and are not intended to limit the scope of the present invention.

In reference to FIGS. 1 through 12, the present invention is a container stability mounting apparatus that allows a user attach or detach a beverage container such as thermal foil flasks to various surfaces or objects such as, but not limited to, outdoor equipment. The present invention comprises an anchoring base 1, a connector sleeve 4, a first attachment mechanism 7, and a second attachment mechanism 14. The anchoring base 1 is a structural support that can be mounted to various surfaces or objects through the second attachment mechanism 14. The connector sleeve 4 can receive a beverage container and can be attached to the anchoring base 1 through the first attachment mechanism 7. With a beverage container situated within the connector sleeve 4, a user can attach or detach the beverage container to various surfaces or objects through the anchoring base 1.

Figure 3:
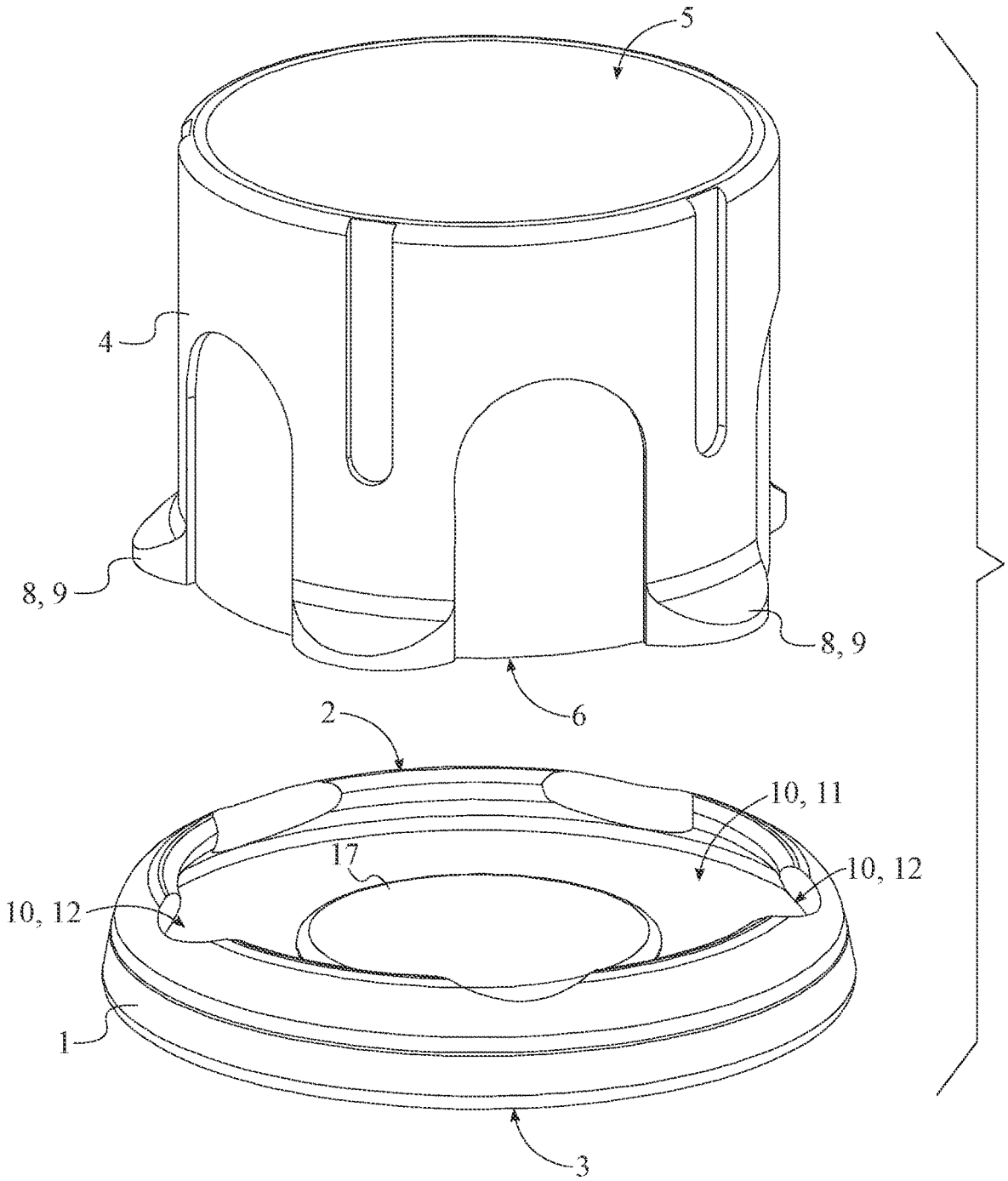
FIG. 3 is an exploded front top perspective view of the present invention.
Figure 4:
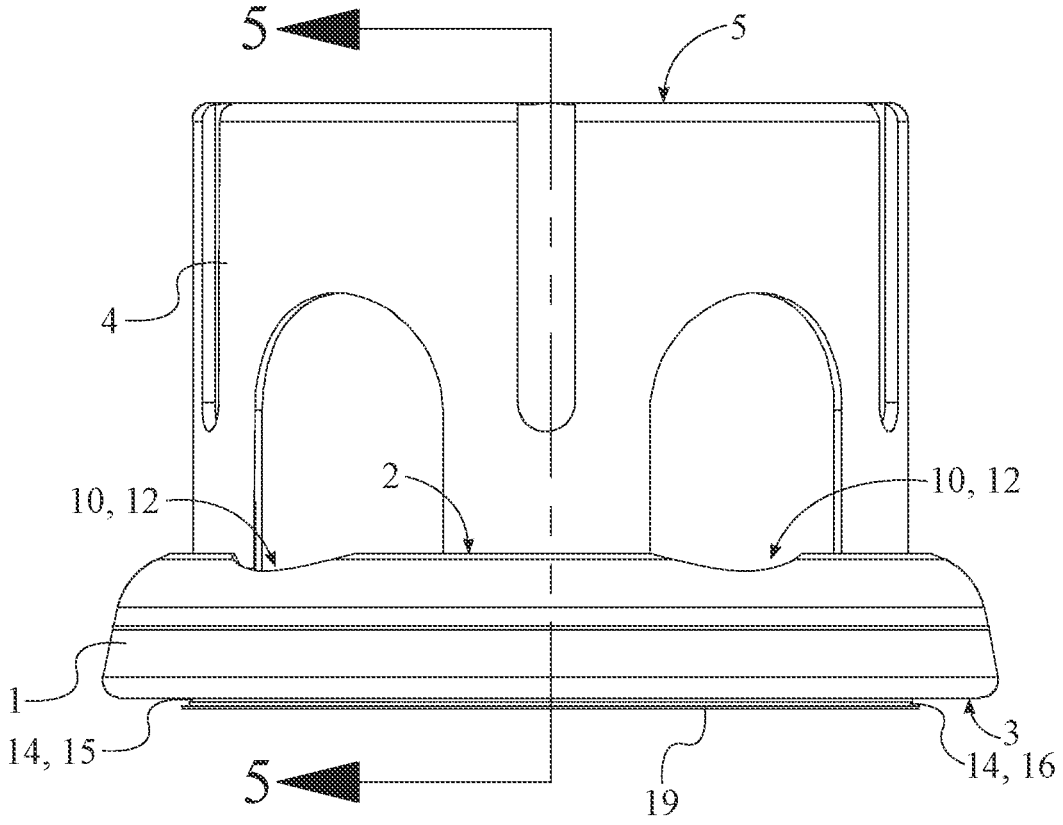
FIG. 4 is a front view of the present invention.

The general configuration of the aforementioned components allows a user to attach or detach a beverage container to various surfaces or object such as outdoor equipment using the present invention. With reference to FIGS. 1 and 3, the connector sleeve 4 comprises an open sleeve end 5 and a closed sleeve end 6. A beverage container can be inserted into the connector sleeve 4 through the open sleeve end 5. The anchoring base 1 comprises a first base face 2 and a second base face 3. The first attachment mechanism 7 comprises a sleeve interlocking portion 8 and a base interlocking portion 10. The sleeve interlocking portion 8 and the base interlocking portion 10 may be part of any type of attachment mechanism such as, but not limited to, key-locking mechanism, a magnetic mechanism, or a fastening-thread mechanism able to attach the connector sleeve 4 to the anchoring base 1. The first base face 2 and the second base face 3 are positioned opposite to each other about the anchoring base 1. The sleeve interlocking portion 8 is integrated about the closed sleeve end 6, and the base interlocking portion 10 is integrated into the first base face 2. This arrangement positions the sleeve interlocking portion 8 and the base interlocking portion 10 to be easily accessible for the user to interlock the sleeve interlocking portion 8 with the base interlocking portion 10. Furthermore, the sleeve interlocking portion 8 is operatively coupled to the base interlocking portion 10, wherein the sleeve interlocking portion 8 and the base interlocking portion 10 are used to detach and attach the connector sleeve 4 to the anchoring base 1. Moreover, the second attachment mechanism 14 is connected across the second base face 3. This arrangement allows the anchoring base 1 to be mounted to various surfaces or objects. The second attachment mechanism 14 may be any type of attachment mechanism such as, but not limited to, an adhesive mechanism, a suction cup mechanism, or a magnetic mechanism. Thus, with a beverage container situated within the connector sleeve 4, the beverage container can be attached or detached to various surfaces or objects through the anchoring base 1.

Figure 6:
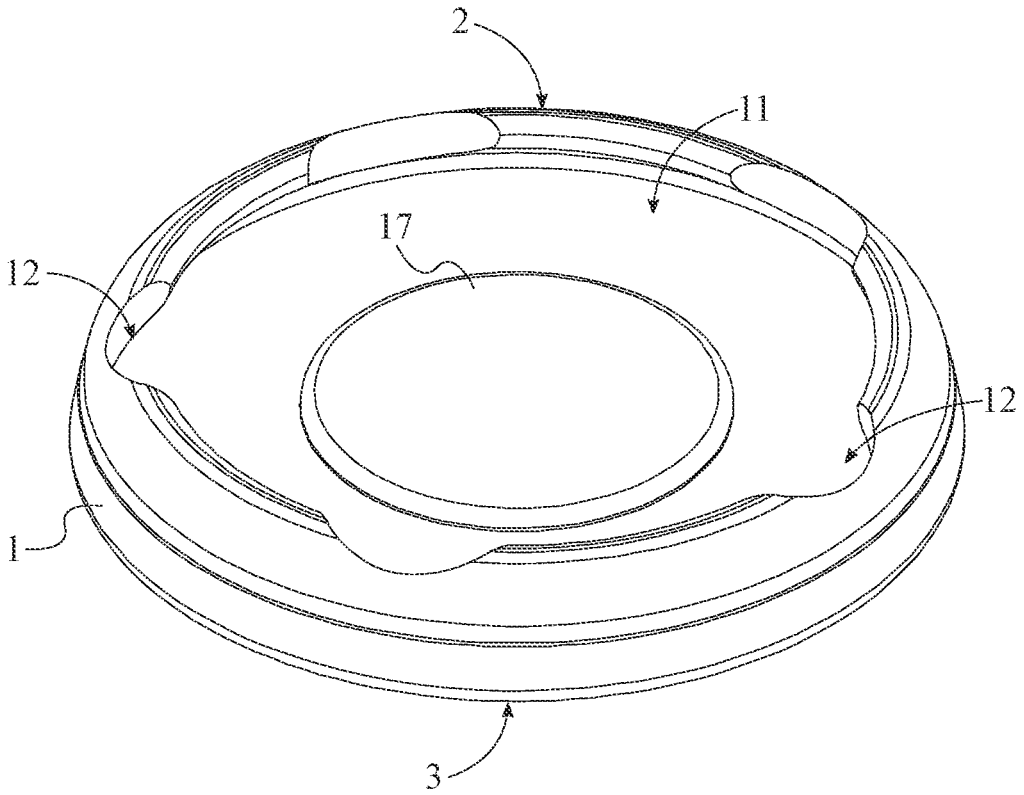
FIG. 6 is a front top perspective view of the anchoring base.
Figure 7:
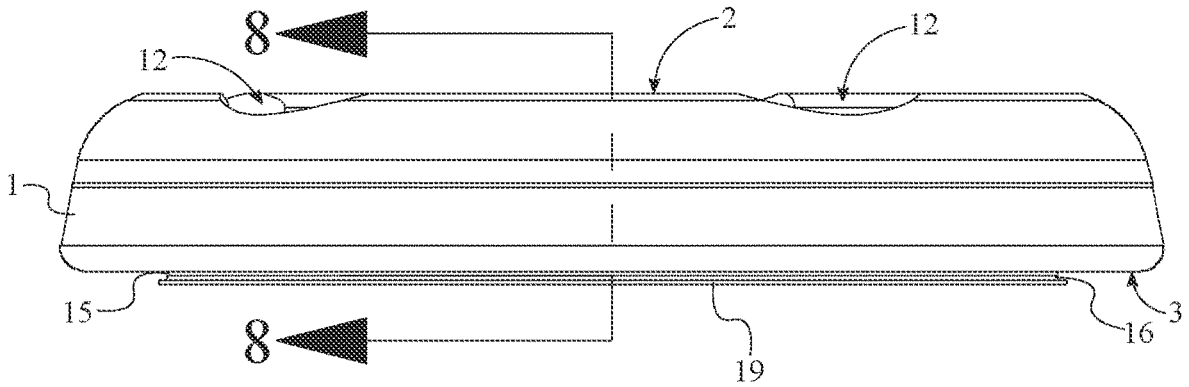
FIG. 7 is a front view of the anchoring base.
Figure 8:
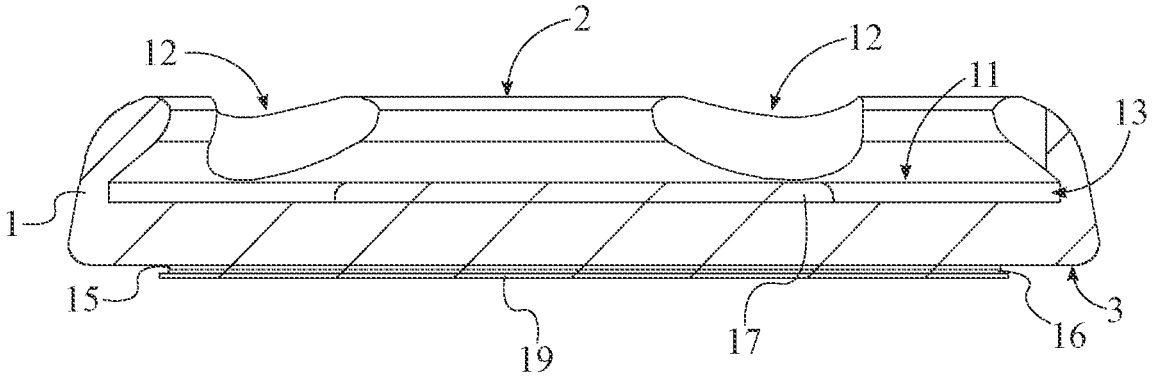
FIG. 8 is a cross-sectional view of the anchoring base taken along line 8-8 in FIG. 7.

As mentioned previously, the sleeve interlocking portion 8 and the base interlocking portion 10 may be part of any type of attachment mechanism. In the preferred embodiment and with reference to FIGS. 3 and 5, the sleeve interlocking portion 8 and the base interlocking portion 10 form a rotation lock mechanism. Therefore, the sleeve interlocking portion 8 comprises a plurality of sleeve protrusions 9, and the base interlocking portion 10 comprises a sleeve-receiving channel 11, a plurality of protrusion-receiving channels 12, and an annular channel 13. The plurality of sleeve protrusions 9 is laterally connected to the connector sleeve 4, is distributed around the connector sleeve 4, and is positioned adjacent to the closed sleeve end 6. This arrangement positions the plurality of sleeve protrusions 9 in order for the plurality of sleeve protrusions 9 to be effectively engaged to the base interlocking portion 10. With reference to FIGS. 6 through 8, the sleeve-receiving channel 11 and each of the plurality of protrusion-receiving channels 12 traverse into the anchoring base 1 from the first base face 2. This arrangement allows the anchoring base 1 to receive the connector sleeve 4 with the sleeve-receiving channel 11 and to receive the plurality of sleeve protrusions 9 with the plurality of protrusion-receiving channels 12. Further, the plurality of protrusion-receiving channels 12 is laterally positioned to the sleeve-receiving channel 11 and is distributed around the sleeve-receiving channel 11. This arrangement allows for the engagement between each of the plurality of sleeve protrusions 9 and each of the plurality of protrusion-receiving channels 12. Moreover, the annular channel 13 is integrated into anchoring base 1. This arrangement allows the connector sleeve 4 to be rotated when the connector sleeve 4 is within the sleeve-receiving channel 11. Additionally, the annular channel 13 is perpendicularly intersected by each of the plurality of protrusion-receiving channels 12. This arrangement allows each of the plurality of sleeve protrusions 9 to be restricted by the anchoring base 1 after the connector sleeve 4 is rotated around the annular channel 13, when within the sleeve-receiving channel 11.

Figure 9:
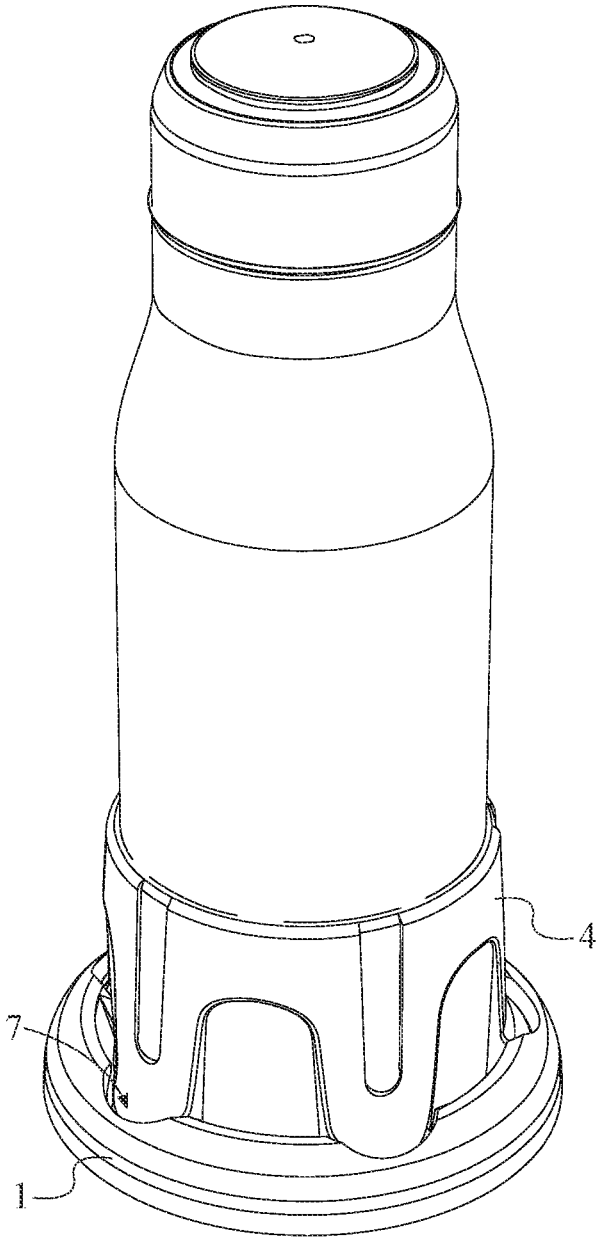
FIG. 9 is a front top perspective view of the present invention with a beverage container within the connector sleeve.
Figure 10:
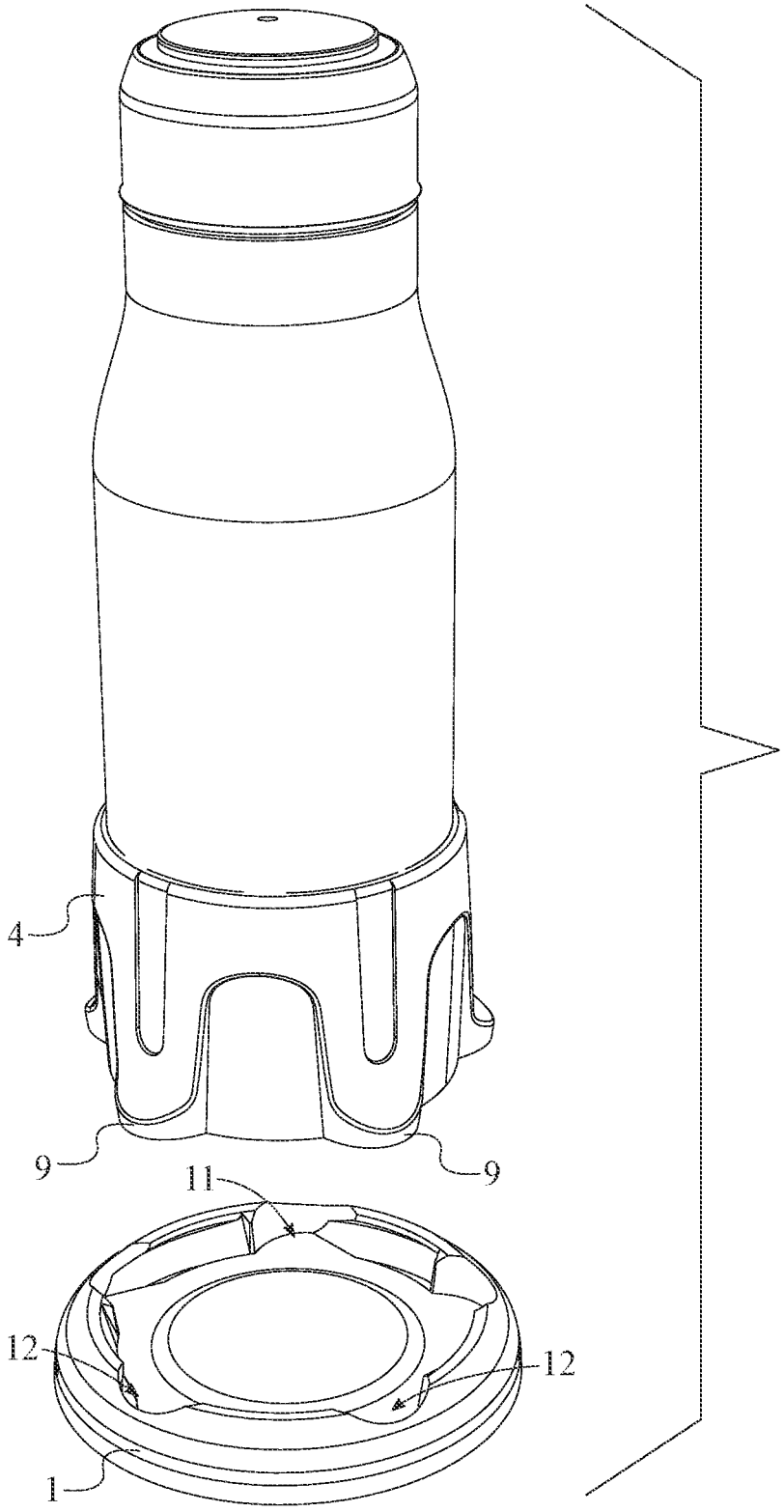
FIG. 10 is an exploded front top perspective view of the present invention with a beverage container within the connector sleeve.

With reference to FIGS. 9 and 10, the anchoring base 1, the connector sleeve 4, and the first attachment mechanism 7 can be arranged into an engaged configuration where the connector sleeve 4 is prepared to be fully secured to or removed from the anchoring base 1. In the engagement configuration, the connector sleeve 4 is positioned into the sleeve-receiving channel 11 and each of the plurality of sleeve protrusions 9 is positioned into a corresponding channel from the plurality of sleeve-receiving channels 11. Thus, the connector sleeve 4 is situated within the anchoring base 1, where the connector sleeve 4 can be fully secured or removed from the anchoring base 1.

Figure 5:
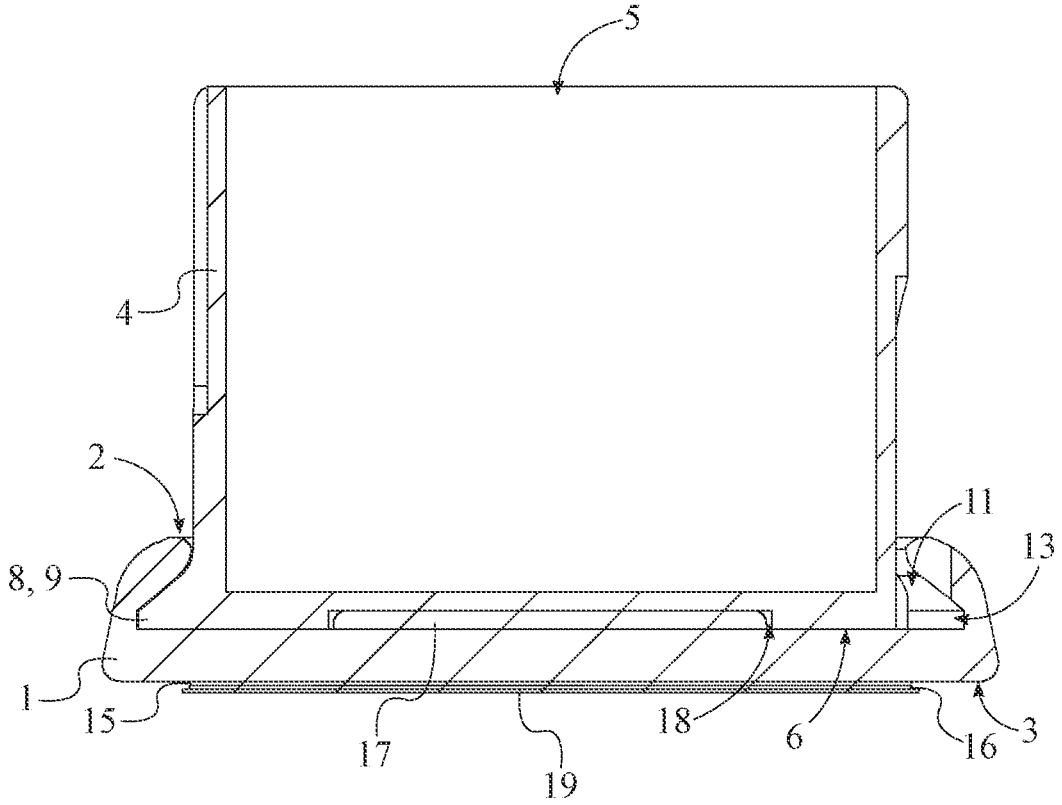
FIG. 5 is a cross-sectional view of the present invention taken along line 5-5 in FIG. 4.

With reference to FIGS. 3 and 5, the anchoring base 1, the connector sleeve 4, and the first attachment mechanism 7 can be arranged into a locked configuration where the connector sleeve 4 is fully secured to the anchoring base 1. In the locked configuration, the connector sleeve 4 is positioned into the sleeve-receiving channel 11, each of the plurality of sleeve protrusions 9 is positioned within the annular channel 13, and each of the plurality of sleeve protrusions 9 is interspersed amongst the plurality of sleeve-receiving channels 11. In more detail, the connector sleeve 4 is rotated around the annular channel 13, while within the sleeve-receiving channel 11, in order to prevent each of plurality of sleeve protrusions 9 from being disengaged from the anchoring base 1. Thus, the connector sleeve 4 can only be detached from the anchoring base 1 by rotating the connector sleeve 4 in the opposite direction.

In order to prevent the connector sleeve 4 from accidentally being rotated when within the anchoring base 1 and with reference to FIG. 5, the present invention may further comprise a mechanism protrusion 17 and a mechanism cavity 18. The mechanism protrusion 17 and the mechanism cavity 18 work together to create friction between the connector sleeve 4 and the anchoring base 1. Thus, a sufficient torque force needs to be applied to rotate the connector sleeve 4 when within the anchoring base 1. The mechanism protrusion 17 is centrally integrated into the first base face 2 in order to be easily accessible by the connector sleeve 4. The mechanism cavity 18 is centrally integrated into the closed sleeve end 6 in order to easily receive the mechanism protrusion 17. Moreover, the mechanism protrusion 17 is frictionally pressed into the mechanism cavity 18. Thus, friction is created between the connector sleeve 4 and anchoring base 1. Therefore, a sufficient torque force must be applied to rotate the connector sleeve 4 when within the anchoring base 1.

As mentioned previously, the second attachment mechanism 14 can be any type of attachment mechanism that allows the anchoring base 1 to be mounted to a surface or object. In the preferred embodiment and with reference to FIGS. 4 and 7, the second attachment mechanism 14 comprises a proximal adhesive portion 15 and a distal adhesive portion 16. The proximal adhesive portion 15 and the distal adhesive portion 16 are positioned opposite to each other about the second attachment mechanism 14. Further, the proximal adhesive portion 15 is fixed across the second base face 3. Thus, the second attachment mechanism 14 is fully secured to the anchoring base 1. The distal adhesive portion 16 is the adhesive portion of the second attachment mechanism 14 that allows the anchoring base 1 to be attached to a surface or object. Moreover and with reference to FIGS. 2 and 4, the present invention may further comprise a sealing cover 19 in order to preserve the adhesive properties of the distal adhesive portion 16 when the present invention is not in use. The sealing cover 19 is removably attached across the distal adhesive portion 16. Thus, the sealing cover 19 can be attached when the present invention is not in use. When the user desires to use the present invention, the user can simply detach the sealing cover 19 to expose the distal adhesive portion 16.

Figure 11:
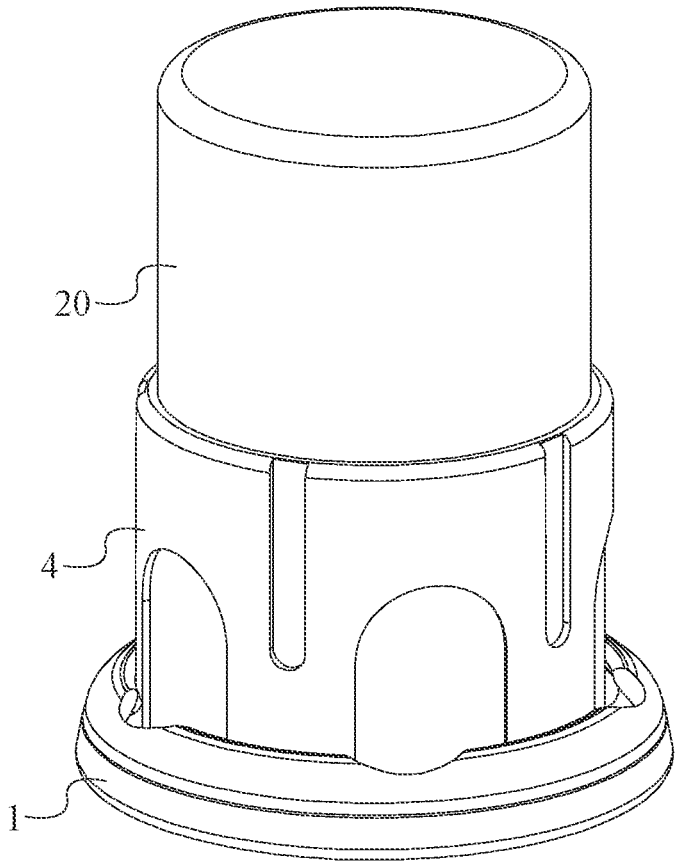
FIG. 11 is a front top perspective view of the present invention with the beverage-container sleeve.
Figure 12:
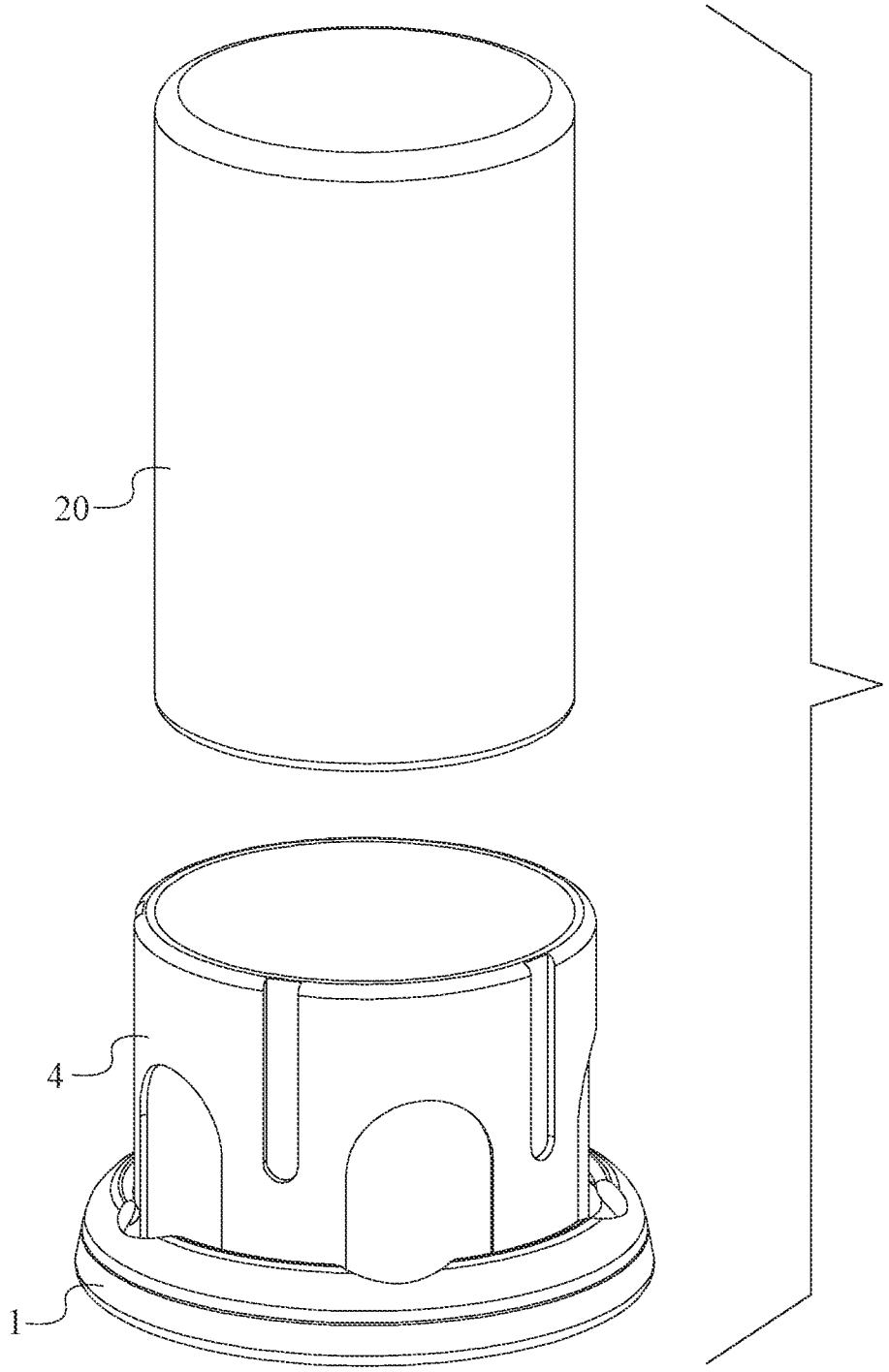
FIG. 12 is an exploded front top perspective view of the present invention with the beverage-container sleeve.

In order to thermally insulate beverage containers that are used with the present invention and with reference to FIGS. 11 and 12, the present invention may further comprise a beverage-container sleeve 20. Preferably, the beverage-container sleeve 20 is a sleeve made of fabric, foam, or other thermal-insulating material. The beverage-container sleeve 20 traverses into the connector sleeve 4 and is laterally connected around the connector sleeve 4. This arrangement fully secures the beverage-container sleeve 20 within the connector sleeve 4. Thus, the present invention can thermally insulate beverage containers that are used with the present invention.

Although the invention has been explained in relation to its preferred embodiment, it is to be understood that many other possible modifications and variations can be made without departing from the spirit and scope of the invention as hereinafter claimed.

What is claimed is:

1. A container stability mounting apparatus comprising:

an anchoring base;

a connector sleeve;

a first attachment mechanism;

a second attachment mechanism;

the connector sleeve comprising an open sleeve end and a closed sleeve end;

the anchoring base comprising a first base face and a second base face;

the first attachment mechanism comprising a sleeve interlocking portion and a base interlocking portion;

the first base face and the second base face being positioned opposite to each other about the anchoring base;

the sleeve interlocking portion being integrated about the closed sleeve end;

the base interlocking portion being integrated into the first base face;

the sleeve interlocking portion being operatively coupled to the base interlocking portion, wherein the sleeve interlocking portion and the base interlocking portion are used to detach and attach the connector sleeve to the anchoring base;

the second attachment mechanism being connected across the second base face;

the sleeve interlocking portion comprising a plurality of sleeve protrusions;

the base interlocking portion comprising a sleeve-receiving channel, a plurality of protrusion-receiving channels, and an annular channel;

the plurality of sleeve protrusions being laterally connected to the connector sleeve;

the plurality of sleeve protrusions being distributed around the connector sleeve;

the plurality of sleeve protrusions being positioned adjacent to the closed sleeve end;

the sleeve-receiving channel and each of the plurality of protrusion-receiving channels traversing into the anchoring base from the first base face;

the annular channel being integrated into the anchoring base;

the plurality of protrusion-receiving channels being laterally positioned to the sleeve-receiving channel;

the plurality of protrusion-receiving channels being distributed around the sleeve-receiving channel;

the annular channel being perpendicularly intersected by each of the plurality of protrusion-receiving channels;

the second attachment mechanism comprising a proximal adhesive portion and a distal adhesive portion;

the proximal adhesive portion and the distal adhesive portion being positioned opposite to each other about the second attachment mechanism;

the proximal adhesive portion being fixed across the second base face;

a sealing cover; and the sealing cover being removably attached across the distal adhesive portion.

2. The container stability mounting apparatus as claimed in claim 1 comprising:

wherein the anchoring base, the connector sleeve, and the first attachment mechanism are in an engagement configuration;

the connector sleeve being positioned into the sleeve-receiving channel; and each of the plurality of sleeve protrusions being positioned into a corresponding channel from the plurality of protrusion-receiving channels.

3. The container stability mounting apparatus as claimed in claim 1 comprising:

wherein the anchoring base, the connector sleeve, and the first attachment mechanism are in a locked configuration;

the connector sleeve being positioned into the sleeve-receiving channel;

each of the plurality of sleeve protrusions being positioned within the annular channel; and the plurality of sleeve protrusions being interspersed amongst the plurality of protrusion-receiving channels.

4. The container stability mounting apparatus as claimed in claim 1 comprising:

a mechanism protrusion;

a mechanism cavity;

the mechanism protrusion being centrally integrated into the first base face;

the mechanism cavity being centrally integrated into the closed sleeve end; and the mechanism protrusion being frictionally pressed into the mechanism cavity.

5. The container stability mounting apparatus as claimed in claim 1 comprising:

a beverage-container sleeve;

the beverage-container sleeve traversing into the connector sleeve; and the beverage-container sleeve being laterally connected around the connector sleeve.

6. A container stability mounting apparatus comprising:

an anchoring base;

a connector sleeve;

a first attachment mechanism;

a second attachment mechanism;

the connector sleeve comprising an open sleeve end and a closed sleeve end;

the anchoring base comprising a first base face and a second base face;

the first attachment mechanism comprising a sleeve interlocking portion and a base interlocking portion;

the sleeve interlocking portion comprising a plurality of sleeve protrusions;

the base interlocking portion comprising a sleeve-receiving channel, a plurality of protrusion-receiving channels, and an annular channel;

the first base face and the second base face being positioned opposite to each other about the anchoring base;

the sleeve interlocking portion being integrated about the closed sleeve end;

the base interlocking portion being integrated into the first base face;

the sleeve interlocking portion being operatively coupled to the base interlocking portion, wherein the sleeve interlocking portion and the base interlocking portion are used to detach and attach the connector sleeve to the anchoring base;

the second attachment mechanism being connected across the second base face;

the plurality of sleeve protrusions being laterally connected to the connector sleeve;

the plurality of sleeve protrusions being distributed around the connector sleeve;

the plurality of sleeve protrusions being positioned adjacent to the closed sleeve end;

the sleeve-receiving channel and each of the plurality of protrusion-receiving channels traversing into the anchoring base from the first base face;

the annular channel being integrated into the anchoring base;

the plurality of protrusion-receiving channels being laterally positioned to the sleeve-receiving channel;

the plurality of protrusion-receiving channels being distributed around the sleeve-receiving channel;

the annular channel being perpendicularly intersected by each of the plurality of protrusion-receiving channels;

a beverage-container sleeve;

the beverage-container sleeve traversing into the connector sleeve; and the beverage-container sleeve being laterally connected around the connector sleeve.

7. The container stability mounting apparatus as claimed in claim 6 comprising:

wherein the anchoring base, the connector sleeve, and the first attachment mechanism are in an engagement configuration;

the connector sleeve being positioned into the sleeve-receiving channel; and each of the plurality of sleeve protrusions being positioned into a corresponding channel from the plurality of protrusion-receiving channels.

8. The container stability mounting apparatus as claimed in claim 6 comprising:

wherein the anchoring base, the connector sleeve, and the first attachment mechanism are in a locked configuration;

the connector sleeve being positioned into the sleeve-receiving channel;

each of the plurality of sleeve protrusions being positioned within the annular channel; and the plurality of sleeve protrusions being interspersed amongst the plurality of protrusion-receiving channels.

9. The container stability mounting apparatus as claimed in claim 6 comprising:

a mechanism protrusion;

a mechanism cavity;

the mechanism protrusion being centrally integrated into the first base face;

the mechanism cavity being centrally integrated into the closed sleeve end; and the mechanism protrusion being frictionally pressed into the mechanism cavity.

10. The container stability mounting apparatus as claimed in claim 6 comprising:

the second attachment mechanism comprising a proximal adhesive portion and a distal adhesive portion;

the proximal adhesive portion and the distal adhesive portion being positioned opposite to each other about the second attachment mechanism; and the proximal adhesive portion being fixed across the second base face.

11. The container stability mounting apparatus as claimed in claim 10 comprising:

a sealing cover; and the sealing cover being removably attached across the distal adhesive portion.

12. A container stability mounting apparatus comprising:

an anchoring base;

a connector sleeve;

a first attachment mechanism;

a second attachment mechanism;

a mechanism protrusion;

a mechanism cavity;

the connector sleeve comprising an open sleeve end and a closed sleeve end;

the anchoring base comprising a first base face and a second base face;

the first attachment mechanism comprising a sleeve interlocking portion and a base interlocking portion;

the sleeve interlocking portion comprising a plurality of sleeve protrusions;

the base interlocking portion comprising a sleeve-receiving channel, a plurality of protrusion-receiving channels, and an annular channel;

the second attachment mechanism comprising a proximal adhesive portion and a distal adhesive portion;

the first base face and the second base face being positioned opposite to each other about the anchoring base;

the sleeve interlocking portion being integrated about the closed sleeve end;

the base interlocking portion being integrated into the first base face;

the sleeve interlocking portion being operatively coupled to the base interlocking portion, wherein the sleeve interlocking portion and the base interlocking portion are used to detach and attach the connector sleeve to the anchoring base;

the second attachment mechanism being connected across the second base face;

the plurality of sleeve protrusions being laterally connected to the connector sleeve;

the plurality of sleeve protrusions being distributed around the connector sleeve;

the plurality of sleeve protrusions being positioned adjacent to the closed sleeve end;

the sleeve-receiving channel and each of the plurality of protrusion-receiving channels traversing into the anchoring base from the first base face;

the annular channel being integrated into the anchoring base;

the plurality of protrusion-receiving channels being laterally positioned to the sleeve-receiving channel;

the plurality of protrusion-receiving channels being distributed around the sleeve-receiving channel;

the annular channel being perpendicularly intersected by each of the plurality of protrusion-receiving channels;

the proximal adhesive portion and the distal adhesive portion being positioned opposite to each other about the second attachment mechanism;

the proximal adhesive portion being fixed across the second base face;

the mechanism protrusion being centrally integrated into the first base face;

the mechanism cavity being centrally integrated into the closed sleeve end;

the mechanism protrusion being frictionally pressed into the mechanism cavity;

a sealing cover;

the sealing cover being removably attached across the distal adhesive portion;

a beverage-container sleeve;

the beverage-container sleeve traversing into the connector sleeve; and the beverage-container sleeve being laterally connected around the connector sleeve.

13. The container stability mounting apparatus as claimed in claim 12 comprising:

wherein the anchoring base, the connector sleeve, and the first attachment mechanism are in an engagement configuration;

the connector sleeve being positioned into the sleeve-receiving channel; and each of the plurality of sleeve protrusions being positioned into a corresponding channel from the plurality of protrusion-receiving channels.

14. The container stability mounting apparatus as claimed in claim 12 comprising:

wherein the anchoring base, the connector sleeve, and the first attachment mechanism are in a locked configuration;

the connector sleeve being positioned into the sleeve-receiving channel;

each of the plurality of sleeve protrusions being positioned within the annular channel; and the plurality of sleeve protrusions being interspersed amongst the plurality of protrusion-receiving channels.

* * * * *